US005580261A

United States Patent [19]

Meynier

[11] Patent Number: 5,580,261

[45] Date of Patent: Dec. 3, 1996

[54] COAXIAL ELECTRICAL CONNECTOR ALSO PERFORMING A SWITCHING FUNCTION

[75] Inventor: Christophe Meynier, Saint Egreve, France

[73] Assignee: Radiall, Rosny-Sous-Bois, France

[21] Appl. No.: 383,529

[22] Filed: Feb. 3, 1995

[30] Foreign Application Priority Data

Feb. 4, 1994 [FR] France ..... 94 01266

[51] Int. Cl.[6] ..... H01R 29/00

[52] U.S. Cl. ..... 439/188; 439/578; 439/944

[58] Field of Search ..... 439/188, 944, 439/578, 180

[56] References Cited

U.S. PATENT DOCUMENTS

| | | | |
|---|---|---|---|
| 3,873,785 | 3/1975 | Lieberman | 439/944 X |
| 4,759,729 | 7/1988 | Kemppainen et al. | 439/944 X |
| 5,076,797 | 12/1991 | Moulton | 439/944 X |
| 5,108,300 | 4/1992 | Weber . | |
| 5,237,293 | 8/1993 | Kan et al. | 439/944 X |
| 5,267,871 | 12/1993 | Flanagan | 439/944 X |
| 5,320,546 | 6/1994 | Weber | 439/944 X |
| 5,445,535 | 8/1995 | Phillips, Jr. et al. | 439/578 X |
| 5,453,019 | 9/1995 | Garver et al. | 439/188 |

FOREIGN PATENT DOCUMENTS

| | | |
|---|---|---|
| 0181306 | 5/1986 | European Pat. Off. . |
| 0393670 | 10/1990 | European Pat. Off. . |
| 0439147 | 7/1991 | European Pat. Off. . |

*Primary Examiner*—Jes F. Pascua
*Attorney, Agent, or Firm*—Schweitzer Cornman & Gross

[57] ABSTRACT

Coaxial electrical connector including:

a first connector element comprising a central conductor and an outer earth conductor which are separated by an insulator and a second connector element comprising a central conductor, an earth conductor which surrounds the central conductor, being separated from the latter by an insulator, and a third conductor which is in electrical contact with the central conductor when said first and second connector elements are disengaged, the first connector element being designed, while it is being connected with the second connector element, to move the said central conductor and the said third conductor of said second connector element away from each other, wherein over the major part of its length, the third conductor (5) of the second connector element (1) is separated from the central conductor (2) by the earth conductor (3).

3 Claims, 3 Drawing Sheets

COAXIAL ELECTRICAL CONNECTOR ALSO PERFORMING A SWITCHING FUNCTION

BACKGROUND OF THE INVENTION

The present invention relates to a coaxial electrical connector assembly which also performs a switching function.

Coaxial connector assemblies are already known which enable one electrical line to be switched to another electrical line when the two elements of the connector are engaged, one in the other.

Such connector assemblies are, in particular, used to connect up portable apparatuses to their mounting sockets, while at the same time switching electronic functions of the portable apparatus with those of the mounting socket, as for example car radiotelephones.

The known connector assembly have the major drawback of not providing good electromagnetic isolation between the two electrical lines to be switched.

SUMMARY OF THE PRESENT INVENTION

The present invention aims to provide a simple and inexpensive coaxial connector assembly which performs a switching function, between two electrical lines, while at the same time ensuring good electromagnetic isolation between the latter.

Such a coaxial electrical connector assembly includes, a first coaxial connector element comprising a central conductor and an outer earth conductor which are separated by an insulator and a second coaxial connector element comprising a central conductor and an earth conductor which surrounds the central conductor, being separated from the latter by an insulator, as well as a third conductor which is in electrical contact with the central conductor when said first and second connector elements are disengaged, the first coaxial connector element being designed, while it is being connected with the second coaxial connector element, to move the said central conductor and the said third conductor of said second connector element away from each other; i.e. to break the electrical contact.

The coaxial electrical connector assembly according to the invention is characterized in that, over the major part of its length, the third conductor of the second coaxial connector element is separated from the central conductor thereof by the earth conductor.

In other words, the third conductor of the second coaxial connector element is arranged outside the coaxial line defined by the central conductor and the earth conductor thereof.

It should be understood that the connector assembly according to the invention provides good electromagnetic isolation between the two electrical lines, comprising the central conductor on the one hand and the third conductor on the other hand, insofar as the earth conductor separates these two lines over the major part of the length of the second connector coaxial element.

In a preferred embodiment of the invention, the earth conductor of the second coaxial connector element includes two portions of different configurations, namely a semicylindrical rear portion defining a partition extending from the rear face of the connector element up to the point of contact between the central conductor and the third conductor and surrounding the central conductor, and a cylindrical front portion defining a partition extending from the said point of contact up to the front face of the connector element and surrounding both the central conductor and the third conductor.

In a preferred variant of this embodiment, the rear portion of the earth conductor includes an additional partition which encloses the third conductor so as to protect the electrical signal conveyed, as the case may be, by this third conductor.

With the aim of making the invention better understood, embodiments thereof will now be described, these being given by way of non-limiting examples of the invention, with reference to the appended drawing in which:

DETAILED DESCRIPTION OF THE INVENTION

Figure 1:
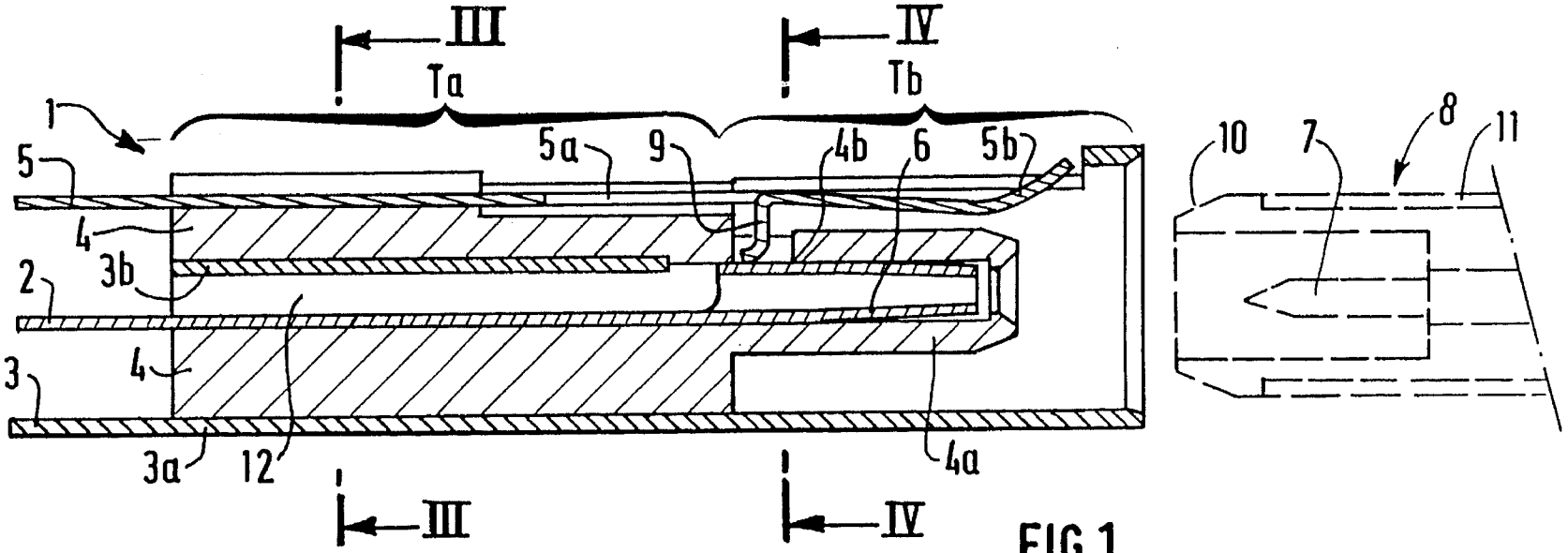
FIG. 1 is an axial sectional view of a second coaxial connector element according to one embodiment with an associated first coaxial connector element shown in phantom.
Figure 2:
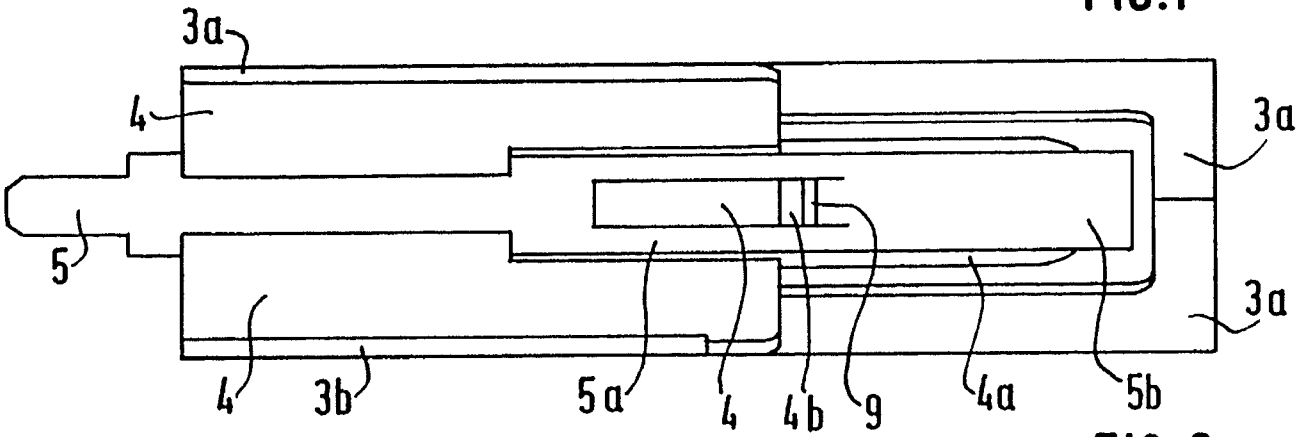
FIG. 2 is a view from above of the connector element of FIG. 1, FIGS. 3 and 4 are respectively sectional views along III—III and IV—IV of FIG. 1.

FIG. 1 depicts, in axial section, a second coaxial connector element 1 which includes a central conductor 2, an earth conductor 3 separated from the central conductor 2 by an insulator 4, and a third conductor 5. The connector element 1 forms a connector assembly with the complementary first connector element 8.

The central conductor 2 is terminated at its front end by a springy socket contact 6 intended to receive the central pin contact 7 of a complementary first coaxial connector element 8 which is shown diagrammatically in FIG. 1 by broken lines.

The insulator 4 extends towards the front in the form of a sleeve **4*a* which surrounds the springy socket contact 6**.

The earth conductor 3 surrounds the central conductor 2 over the entire length of the connector element.

Figure 3:
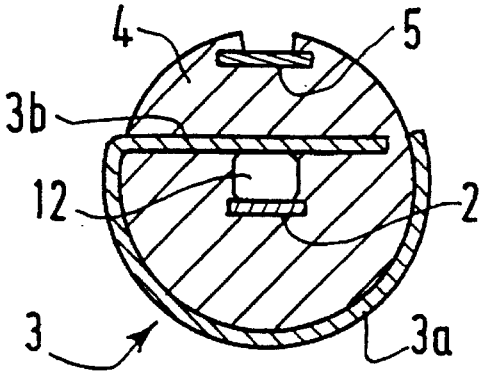
Figure 4:
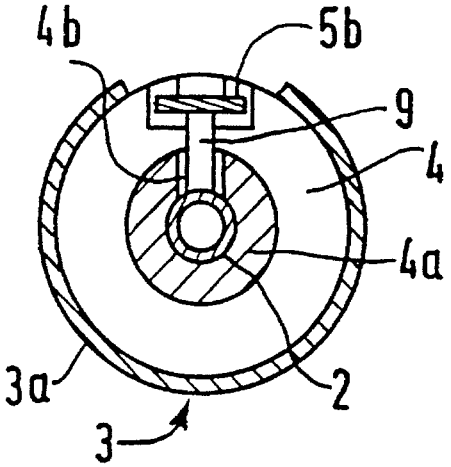

In the sectional views of FIGS. 3 and 4, it may be seen that the earth conductor 3 includes a rear portion Ta and a front portion Tb which have different configurations.

The rear portion Ta of the earth conductor 3, which may be seen in FIG. 3, includes a lower partition **3*a* of circular cross-section and a plane upper partition 3*b*, whereas the front portion 3*b* of the earth conductor 3 is solely formed by the circular partition 3*a*** which extends over the major part of the periphery of the connector element.

The third conductor 5 extends parallel to the plane upper partition **3*b* of the earth conductor 3 and includes a contact foot 9 cut out in its width which bears, in the rest position, on the springy socket contact 6 of the central conductor 2 when the two complementary connector elements 1 and 8** are disengaged.

For this purpose, the sleeve **4*a* of the insulator 4 includes a slot 4*b* allowing passage of the foot 9**.

The third conductor 5 is trapped in the insulator 4 at its rear part and free at its front part where it includes a flexible zone **5*a* which allows it to deform when the two connector elements are being connected, its spatulate termination 5***b* bearing on the bevelled front part 10 of the complementary connector element 8.

While the third conductor 5 is deforming, the contact foot 9 moves away from the central conductor 2 and opens the electrical circuit formed by the central conductor 2 and the third conductor 5.

Moreover, when the two connector elements 1 and 8 are completely engaged, one in the other, to form a connector assembly the spatulate termination 5*b* of the third conductor 5 can come into contact with the outer earth conductor 11 of the complementary connector element 8.

In accordance with the invention, the greater part of the length of the third conductor 5 is separated from the central conductor 2 by the earth conductor 3.

Thus, the electrical lines comprising respectively the central conductor 2 and the third conductor 5 are electrically decoupled.

Figure 7:
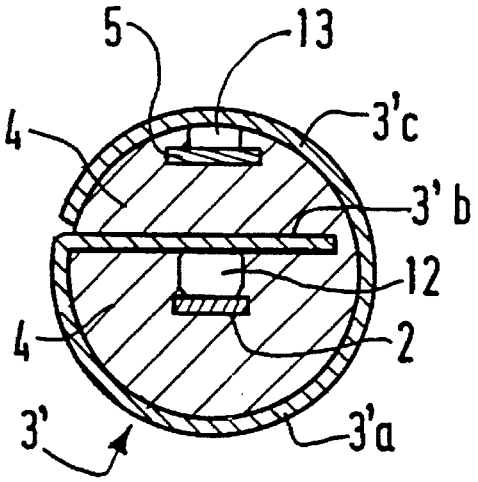
FIG. 7 is a sectional view along VII—VII of FIG. 6.
Figure 5:
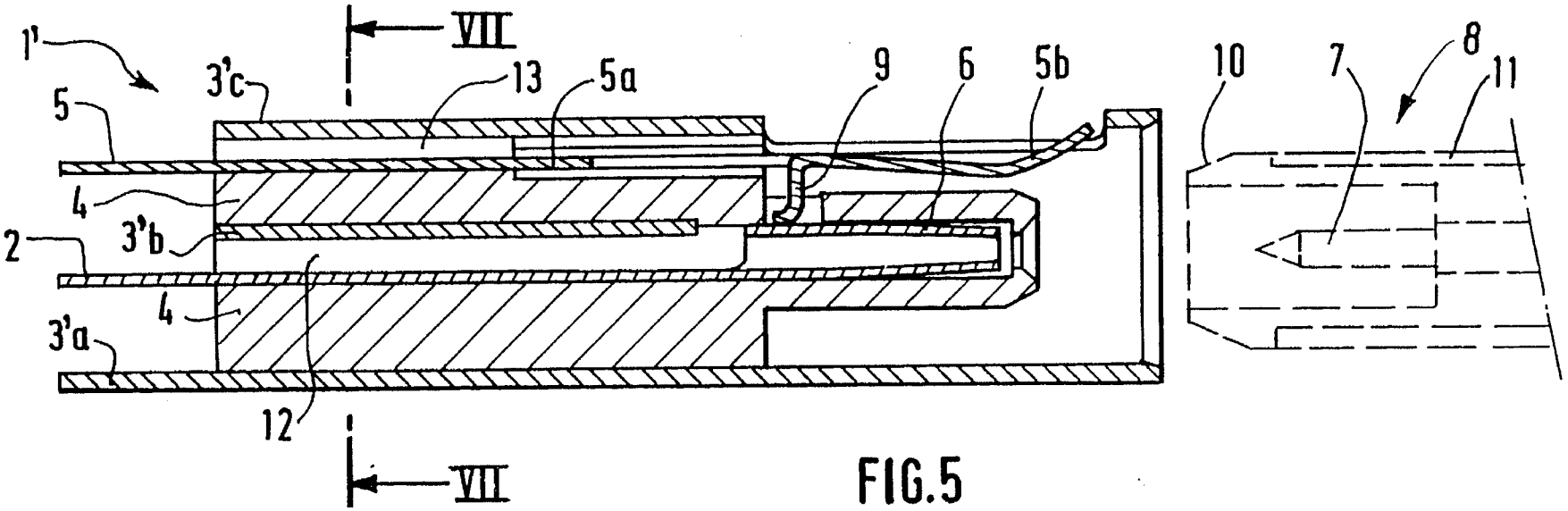
FIG. 5 is an axial sectional view of a second connector element according to a second embodiment.
Figure 6:
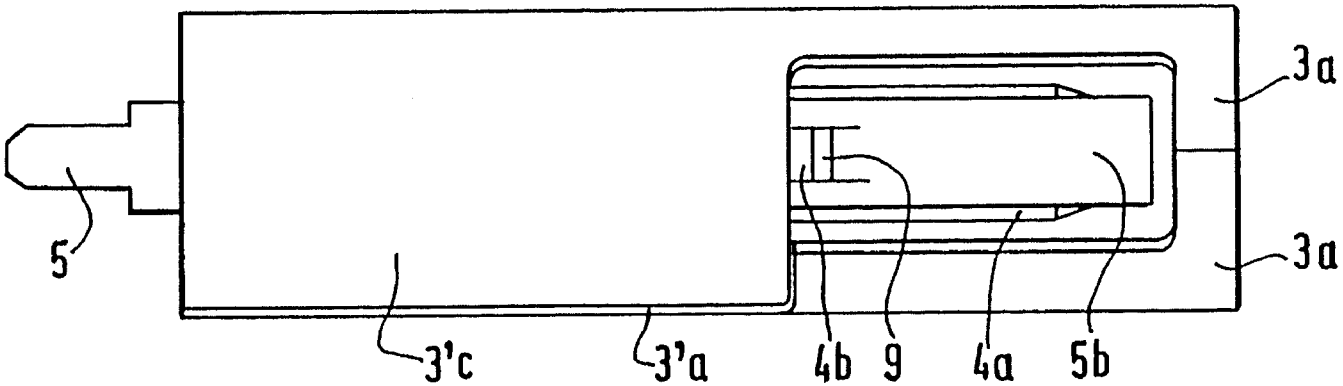
FIG. 6 is a view from above of FIG. 5.

In the embodiment illustrated in FIGS. 5, 6 and 7, the earth conductor 3' of the connector element 1' includes an additional partition 3'c which extends the lower partition 3'*a* and encloses the third conductor 5 so that the latter is also isolated from the outside.

In this case, the central conductor 2 and the third conductor 5 are nevertheless separated by the earth conductor 3, the plane part 3*b* of which divides the internal volume of the connector element into two parts, as may be seen in the sectional view of FIG. 7.

In both embodiments described here, the impedance of each electrical line may be precisely fixed by suitably choosing the size of the air cavities 12 and 13 which respectively separate the earth conductor 3,3' from the central conductor 2 and from the third conductor 5.

I claim:

1. A coaxial electrical connector assembly comprising a first coaxial connector element (8) and a second coaxial connector element (1), (a) said first coaxial connector element (8) including a central conductor (7) and an outer earth conductor (11), (b) said second coaxial connector element (1) is engageable with the first connector element (8) to establish a coaxial connection of the central and outer conductors, (c) said second coaxial connector element (1) including a central conductor (2), an earth conductor (3) surrounding the central conductor (2) and being separated therefrom by an insulator (4), and a third conductor (5) which is normally in electrical contact with the central conductor (2) when said second connector element (1) is not engaged with the first connector element (8), (d) the first connector element (8) having a portion (10) adapted to engage and to move the central conductor (2) away from the third conductor (5) of said second connector element, (e) the third conductor (5) of the second connector element (1) over the major part of its length is separated from the central conductor (2) thereof by the earth conductor (3), ensuring good electromagnetic isolation of the central conductor (2) from the third conductor (5).

2. A coaxial connector assembly according to claim 1, in which the earth conductor (3) of the second connector element (1) includes a rear portion (Ta) having partitions which surround the central conductor (2) and a front portion (Tb) having a partition (3*a*) surrounding both the central conductor (2) and the third conductor (5).

3. A coaxial connector assembly according to claim 2, in which (a) the rear portion (Ta) of the earth conductor of the second connector element (1) includes an additional partition (3'*c*) which encloses the third conductor (5).

* * * * *